US011426643B2

(12) United States Patent
Duffy

(10) Patent No.: US 11,426,643 B2
(45) Date of Patent: Aug. 30, 2022

(54) STRIKE RECORDING PUNCHING BAG ASSEMBLY

(71) Applicant: Ralph Duffy, Bridgeport, OH (US)

(72) Inventor: Ralph Duffy, Bridgeport, OH (US)

( * ) Notice: Subject to any disclaimer, the term of this patent is extended or adjusted under 35 U.S.C. 154(b) by 219 days.

(21) Appl. No.: 16/837,073

(22) Filed: Apr. 1, 2020

(65) Prior Publication Data

US 2021/0308548 A1 Oct. 7, 2021

(51) Int. Cl.
*A63B 69/32* (2006.01)
*A63B 71/06* (2006.01)

(52) U.S. Cl.
CPC ..... *A63B 69/32* (2013.01); *A63B 71/0622* (2013.01); *A63B 2220/17* (2013.01); *A63B 2220/53* (2013.01); *A63B 2220/56* (2013.01); *A63B 2225/50* (2013.01)

(58) Field of Classification Search
None
See application file for complete search history.

(56) References Cited

U.S. PATENT DOCUMENTS 4,974,833 A * 12/1990 Hartman ..... A63B 69/0053 482/84
7,874,964 B2 1/2011 Reynolds
8,766,925 B2 7/2014 Perlin et al.
9,061,194 B2 * 6/2015 Iglehart ..... A63B 69/205
9,320,954 B1 * 4/2016 Simpkins ..... A63B 69/004
9,943,742 B2 * 4/2018 Burt, Jr. ..... A63B 69/32
10,213,672 B2 * 2/2019 Codrington ..... B32B 27/065
2008/0125293 A1 * 5/2008 Ng ..... A63B 69/32 482/84
2010/0001471 A1 * 1/2010 Cho ..... A63B 67/06 273/348.4
2011/0130183 A1 * 6/2011 Pelletter ..... A63F 13/245 463/7
2012/0214647 A1 * 8/2012 Ji ..... A63B 71/06 482/8
2013/0296141 A1 * 11/2013 Partlo ..... A63B 71/0622 482/84

(Continued)

FOREIGN PATENT DOCUMENTS

CN 201426956 * 3/2010 ..... A63B 69/34
CN 201426956 Y * 3/2010

(Continued)

*Primary Examiner* — Sundhara M Ganesan
*Assistant Examiner* — Shila Jalalzadeh Abyaneh

(57) ABSTRACT

A strike recording punching bag assembly includes a striking pad that is positionable at a beneficial location for striking training for receiving strikes from a trainee. A striking panel is positioned within the striking pad and the striking panel has a plurality of depressions therein. A plurality of pressure sensors is each of the pressure sensors is integrated into the striking pad to sense pressure from strikes delivered to the striking pad. Additionally, each of the pressure sensors is positioned in a respective depression. A transmitter is integrated into the striking pad and the transmitter is in communication with each of the pressure sensors. The transmitter is in wireless communication with an extrinsic electronic device wherein the transmitter is configured to facilitate the extrinsic electronic device to display the pressure sensed by the pressure sensors for enhancing feedback to the trainee.

8 Claims, 5 Drawing Sheets

(56) References Cited

U.S. PATENT DOCUMENTS

| | | | | |
|---|---|---|---|---|
| 2014/0206504 | A1* | 7/2014 | Barreras | A63B 69/201 482/8 |
| 2015/0119207 | A1* | 4/2015 | Yi | A63B 69/32 482/84 |
| 2015/0375079 | A1* | 12/2015 | Wood | A63B 69/32 482/8 |
| 2016/0074734 | A1* | 3/2016 | Tsai | A63B 24/0062 482/8 |
| 2017/0348576 | A1 | 12/2017 | Pajonk-Taylor | |
| 2018/0028891 | A1* | 2/2018 | DeLaRosa | A63B 69/34 |
| 2018/0178103 | A1* | 6/2018 | Zhang | A63B 69/004 |
| 2019/0388760 | A1* | 12/2019 | Morin | A63B 69/32 |
| 2021/0106896 | A1* | 4/2021 | Fountaine | A63B 6/00 |

FOREIGN PATENT DOCUMENTS

| | | | | | |
|---|---|---|---|---|---|
| CN | 102512811 | | * | 6/2012 | A63B 69/22 |
| CN | 102512811 | A | * | 6/2012 | |
| CN | 108721860 | A | * | 11/2018 | |
| CN | 110368658 | A | * | 10/2019 | |
| CN | 111111138 | A | * | 5/2020 | |
| KR | 20090120307 | A | * | 11/2009 | A63B 67/02 |
| KR | 20200026023 | A | * | 3/2020 | A63B 69/345 |
| WO | WO2005068028 | | | 7/2005 | |

* cited by examiner

STRIKE RECORDING PUNCHING BAG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to strike recording devices and more particularly pertains to a new strike recording device for recording the location and pressure of strikes delivered during striking training.

(2) Description of Related Art Including Information Disclosed Under 37 CFR 1.97 and 1.98

The prior art relates to strike recording devices, including a punching bag which includes a plurality of sensors for sensing strikes delivered to the punching bag. The prior art also discloses a punching bag that has a plurality of air chambers being integrated therein and a plurality of pressure sensors in a respective one of the air chambers for sensing changes in air pressure caused by strikes delivered to the punching bag. The prior art discloses a smart punching bag that includes a position senor that detects the orientation of a suspended punching bag for extrapolating data pertaining to strikes delivered to the suspended punching bag. The prior art discloses an electronic pressure sensor for delivering pressure data to a control circuit. Additionally, the prior art discloses a fluid filled punching bag that has an impact sensor integrated therein for sensing pressure from strikes delivered to the fluid filled punching bag.

BRIEF SUMMARY OF THE INVENTION

An embodiment of the disclosure meets the needs presented above by generally comprising a striking pad that is positionable at a beneficial location for striking training for receiving strikes from a trainee. A striking panel is positioned within the striking pad and the striking panel has a plurality of depressions therein. A plurality of pressure sensors is each of the pressure sensors is integrated into the striking pad to sense pressure from strikes delivered to the striking pad. Additionally, each of the pressure sensors is positioned in a respective depression. A transmitter is integrated into the striking pad and the transmitter is in communication with each of the pressure sensors. The transmitter is in wireless communication with an extrinsic electronic device wherein the transmitter is configured to facilitate the extrinsic electronic device to display the pressure sensed by the pressure sensors for enhancing feedback to the trainee.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
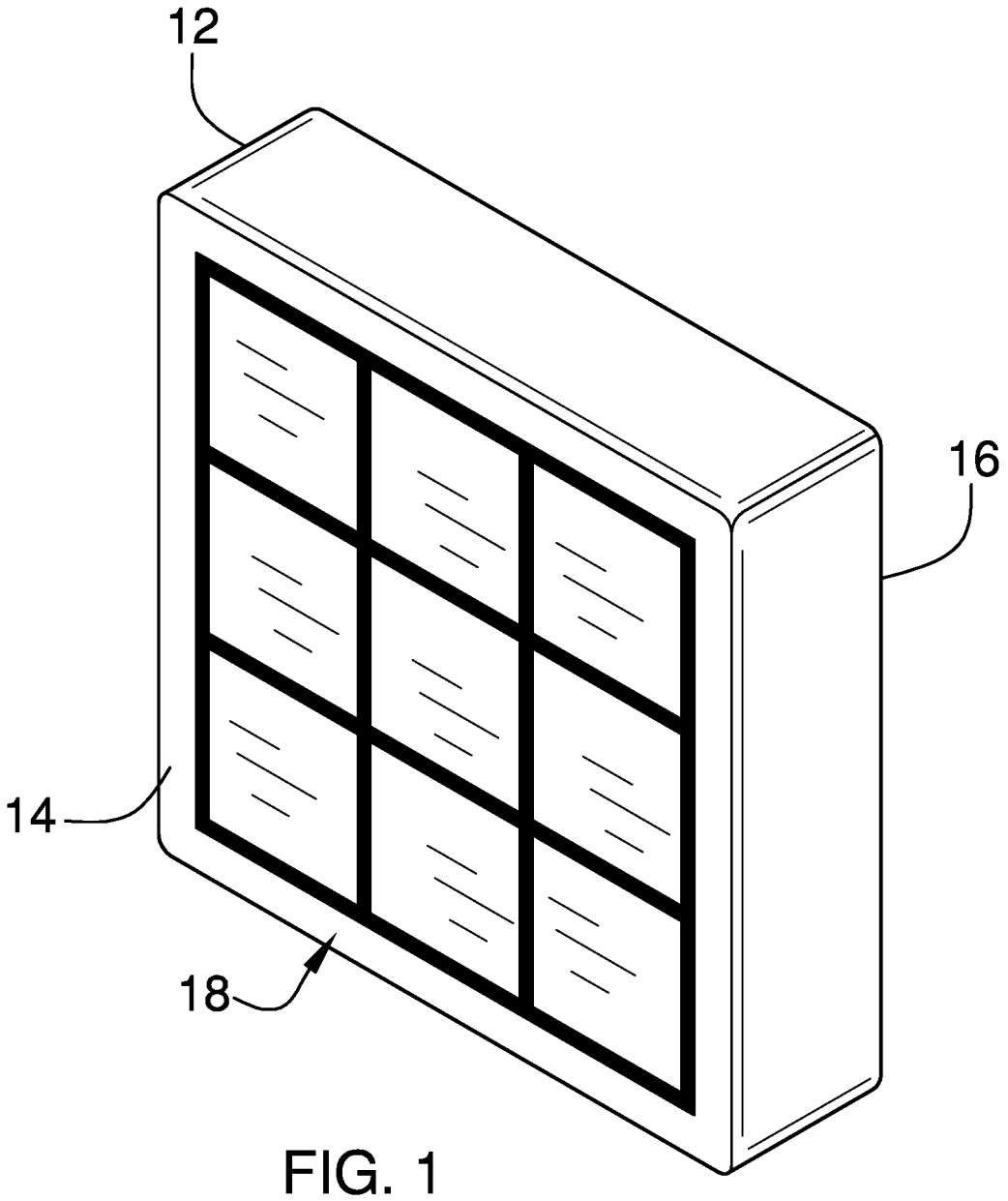
FIG. 1 is a front perspective view of a strike recording punching bag assembly according to an embodiment of the disclosure.
Figure 2:
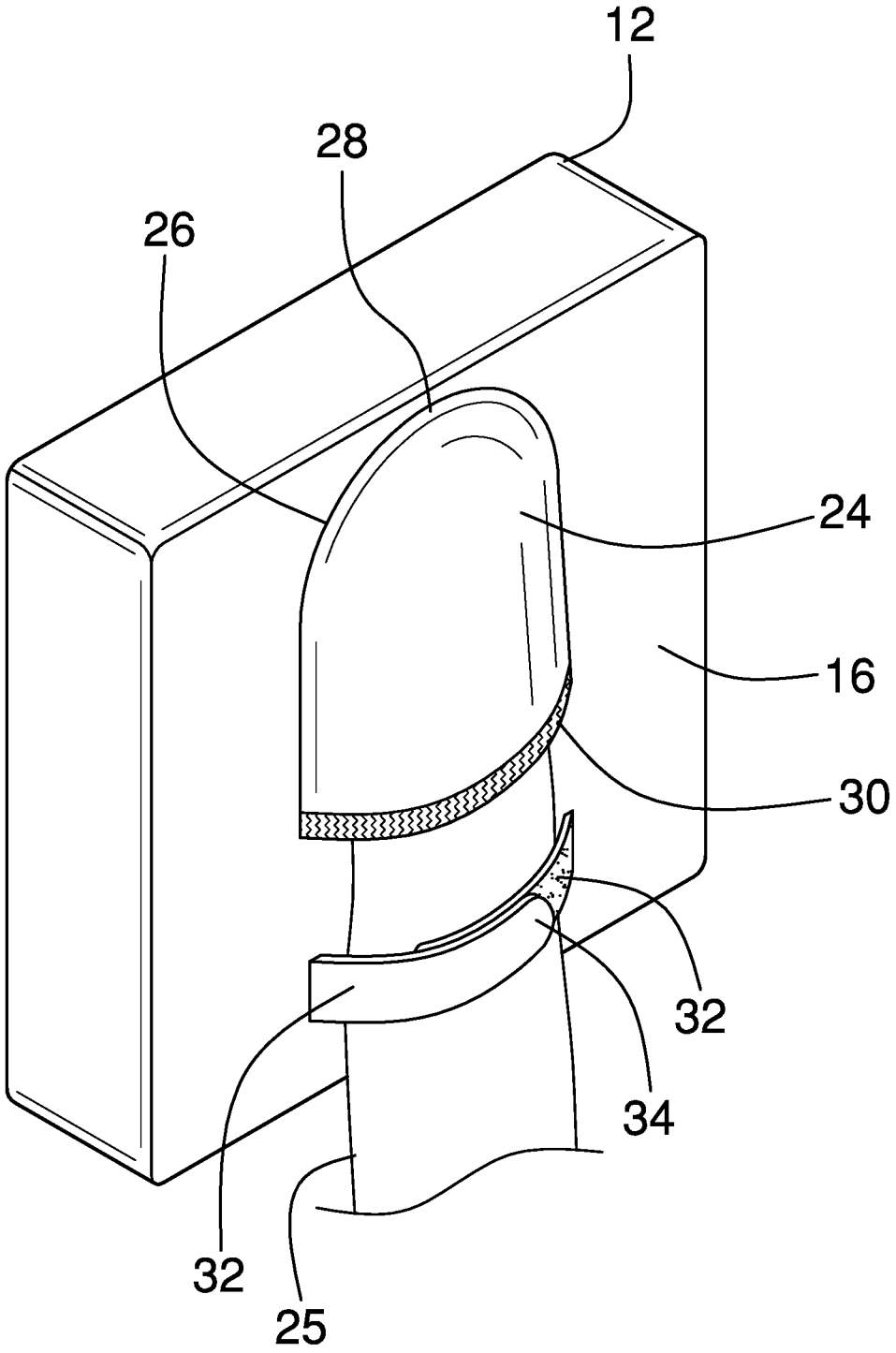
FIG. 2 is a back perspective view of an embodiment of the disclosure.
Figure 3:
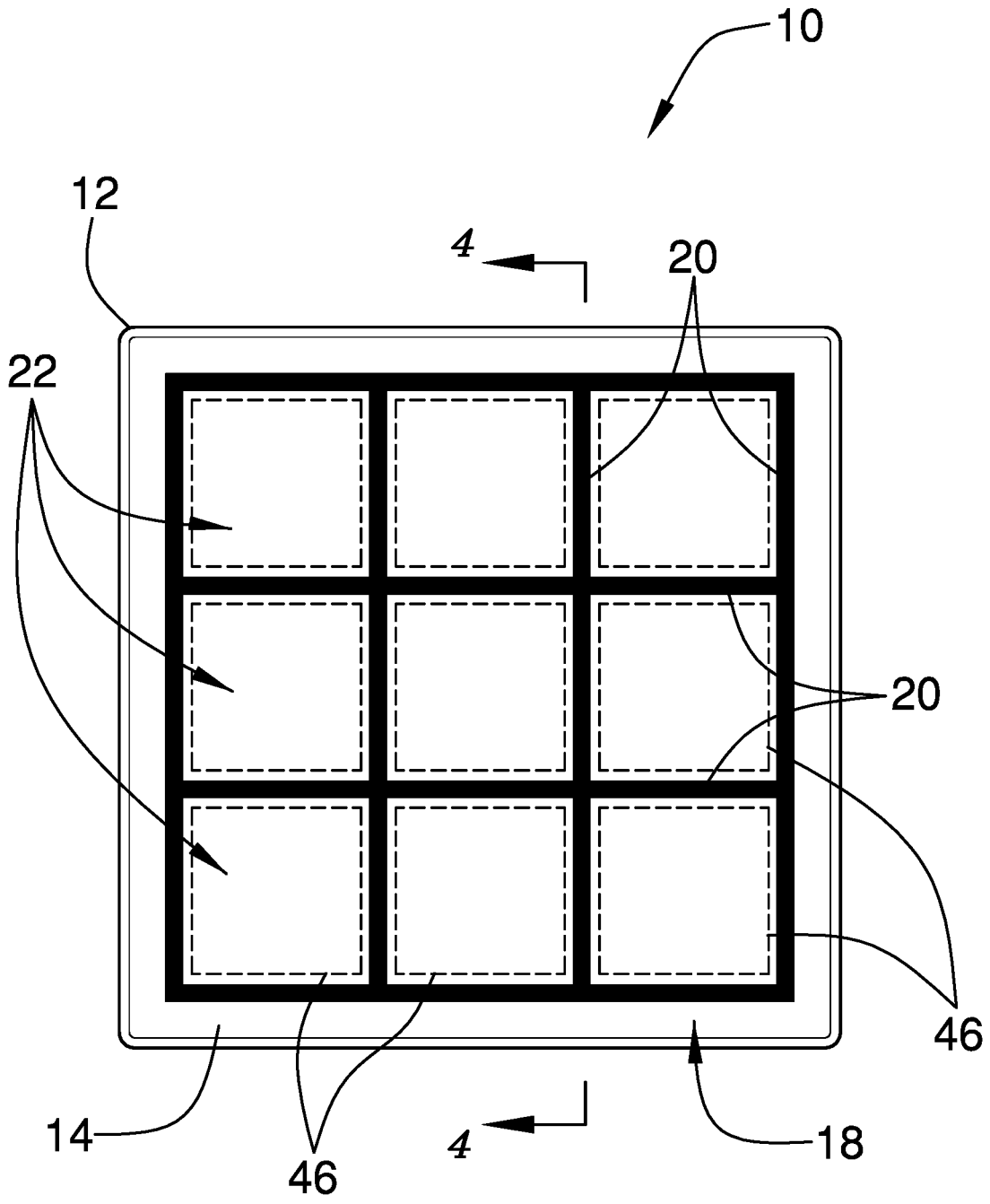
FIG. 3 is a front view of an embodiment of the disclosure.
Figure 4:
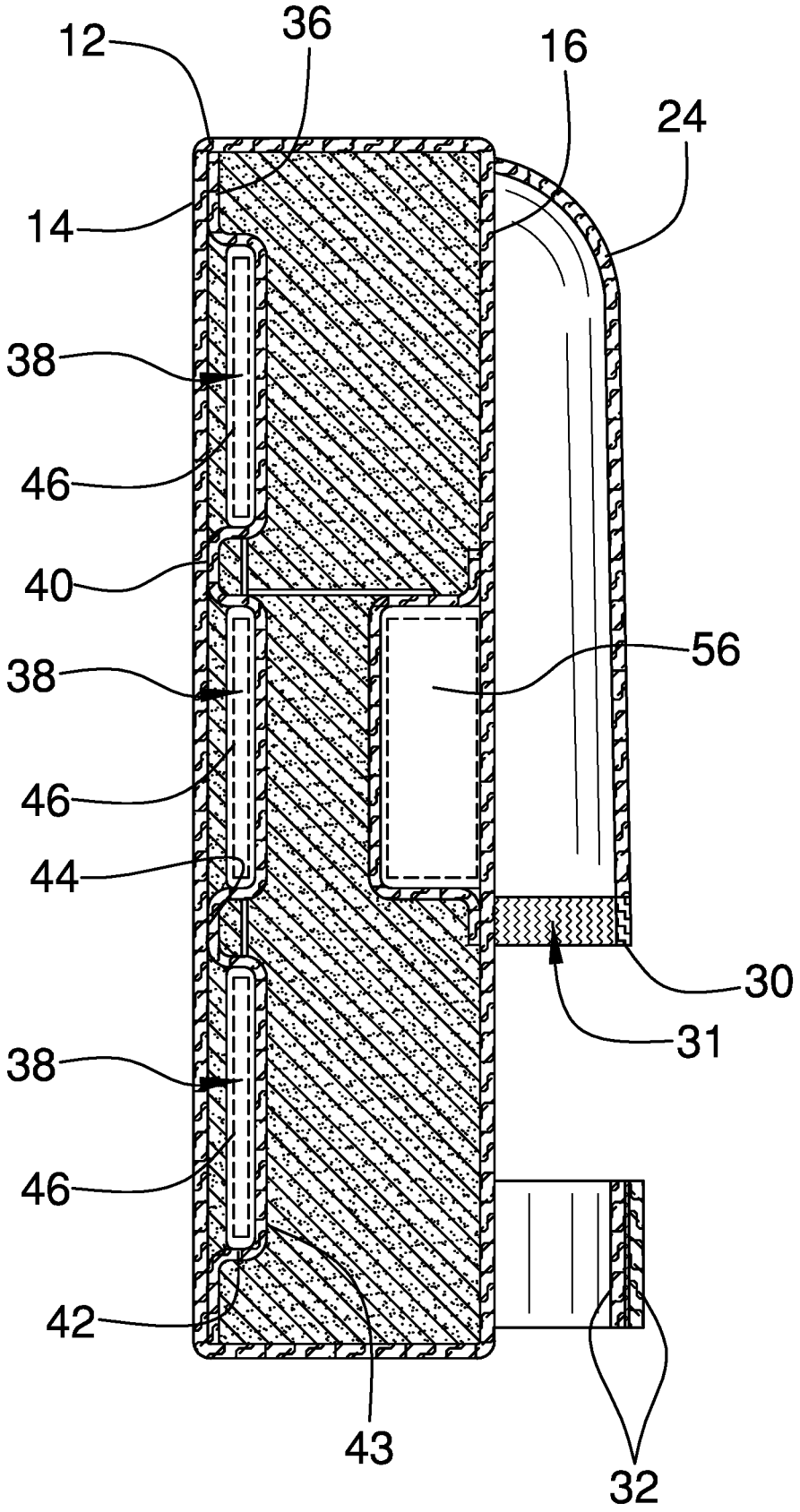
FIG. 4 is a cross sectional view taken along line 4-4 of FIG. 3 of an embodiment of the disclosure.
Figure 5:
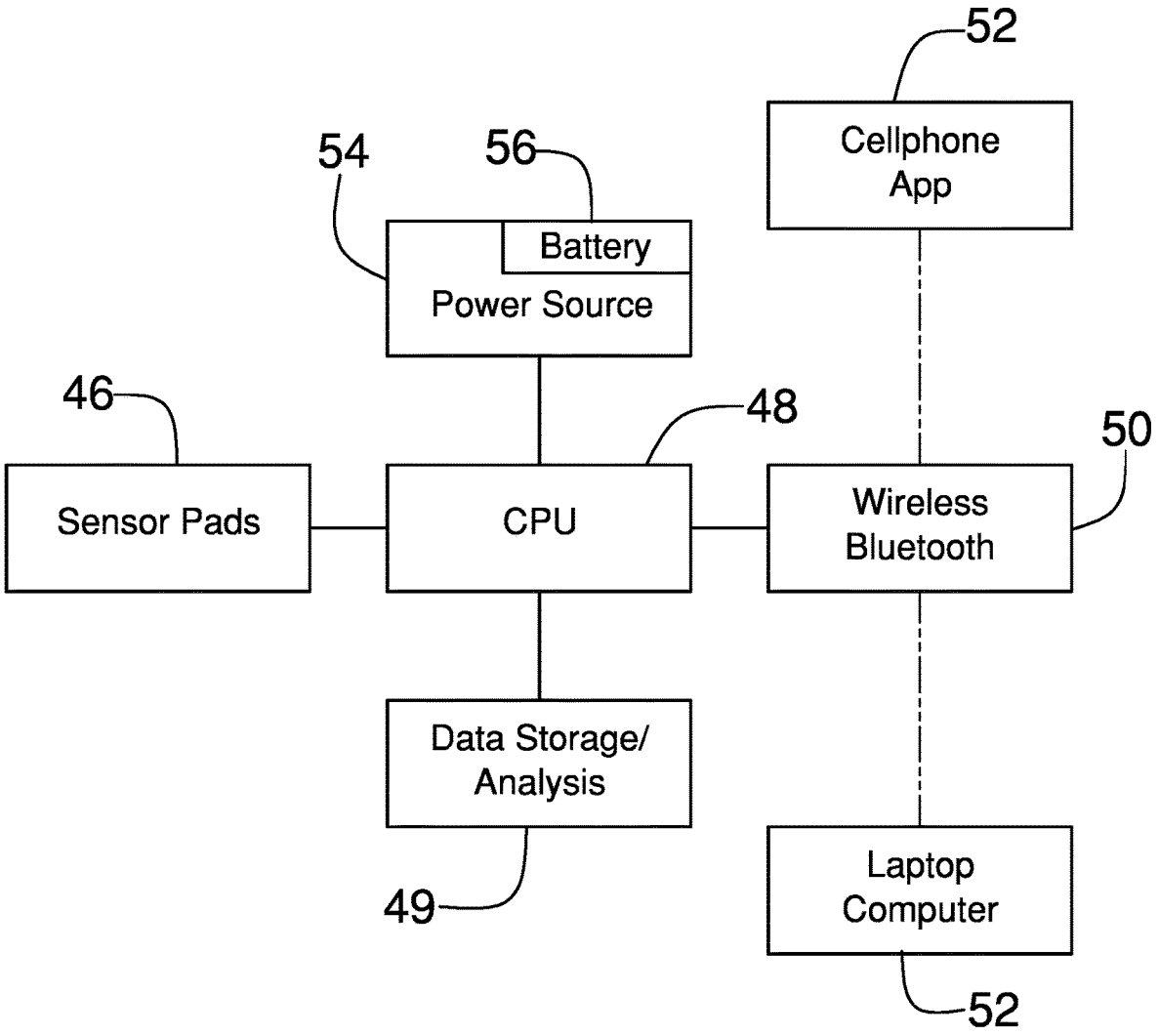
FIG. 5 is a schematic view of an embodiment of the disclosure.

With reference now to the drawings, and in particular to FIGS. 1 through 5 thereof, a new strike recording device embodying the principles and concepts of an embodiment of the disclosure and generally designated by the reference numeral 10 will be described.

As best illustrated in FIGS. 1 through 5, the strike recording punching bag assembly 10 generally comprises a striking pad 12 that is positionable at a beneficial location for striking training for receiving strikes from a trainee. The trainee may be participating in boxing training, martial arts training or any other type of striking training. The striking pad 12 has a forward wall 14 and a rear wall 16, and the striking pad 12 is comprised of a resiliently compressible material to enhance comfort for the trainee. The forward wall 14 has indicia 18 printed thereon and the indicia 18 comprise a plurality of intersecting lines 20 which defines a grid of rectangles 22 positioned on the forward wall 14. The trainee can direct punches, kicks and other strikes at any one of the rectangles 22.

A coupling 24 is coupled to the striking pad 12 to engage a support 25 for retaining the striking pad 12 on the support 25. The support 25 might be a stanchion or other similar, vertically oriented support. The coupling 24 has a perimeter edge 26, and the perimeter edge 26 has first side 28 and a second side 30. The first side 28 is convexly arcuate with respect to the second side 30 and the first side 28 is bonded to the rear wall 16 of the striking pad 12. The second side 30 is free from the rear wall 16 to define an opening 31 into the coupling 24 for receiving the support 25.

A pair of straps 32 is each coupled to the striking pad 12 and each of the straps 32 is matable to each other for securing around the support 25. Each of the straps 32 is positioned on the rear wall 16 of the striking pad 12 and each of the straps 32 has a distal end 34 with respect to each other. The straps 32 are oriented such that the distal end 34 of each of the straps 32 is directed toward each other. Moreover, the pair of straps 32 forms a closed loop when the pair of straps 32 is mated to each other. Each of the straps 32 is spaced from the second side 30 of the perimeter edge 26 of the coupling 24, and each of the straps 32 may comprise respective portions of a hook and loop fastener or the like.

A striking panel 36 is provided and the striking panel 36 is positioned within the striking pad 12. The striking panel 36 has a plurality of depressions 38 therein and the striking panel 36 has a front surface 40. Each of the depressions 38 is defined by a perimeter bounding wall 42 extending rearwardly from the front surface 40 and a rear bounding wall 43 that is spaced from the front surface 40. The front surface 40 of the striking panel 36 is bonded to an inside surface 44 of the forward wall 14 of the striking pad 12 having the rear bounding wall 43 of each of the depressions 38 being spaced from the inside surface 44 of the forward wall 14. Each of the depressions 38 is aligned with a respective one of the rectangles 22 on the forward wall 14.

A plurality of pressure sensors 46 is each integrated into the striking pad 12 wherein to sense pressure from strikes delivered to the striking pad 12. Each of the pressure sensors 46 is positioned within a respective one of the depressions 38 in the striking panel 36. In this way each of the pressure sensors 46 is positioned behind the inside surface 44 of the forward wall 14 of the striking pad 12. Each of the pressure sensors 46 may comprise an electronic pressure sensor of any conventional design. A control circuit 48 is integrated into the striking pad 12 and each of the pressure sensors 46 is electrically coupled to the control circuit 48. The control circuit 48 receives pressure data from each of the pressure sensors 46 when the pressure sensors 46 are struck. An electronic memory 49 is integrated into the striking pad 12 and the electronic memory 49 is electrically coupled to the control circuit 48 for storing the pressure data.

A transmitter 50 is provided and the transmitter 50 is integrated into the striking pad 12. The transmitter 50 is electrically coupled to the control circuit 48 and the transmitter 50 receives the pressure data from the control circuit 48. Additionally, the transmitter 50 is in wireless communication with an extrinsic electronic device 52, such as a smart phone or other similar device. In this way the transmitter 50 facilitates the extrinsic electronic device 52 to display the pressure sensed by the pressure sensors 46 for enhancing feedback to the trainee. The transmitter 50 may comprise a radio frequency transmitter or the like and the transmitter 50 may employ Bluetooth communication protocols. A power supply 54 is integrated into the striking pad 12, the power supply 54 is electrically coupled to the control circuit 48 and the power supply 54 comprises at least one battery 56.

In use, the striking pad 12 is mounted in a location that is preferred by the trainee for delivering strikes to the striking pad 12. Respective ones of the pressure sensors 46 senses the pressure exerted by the strike delivered by the trainee. Additionally, the transmitter 50 broadcasts the pressure data to the extrinsic electronic device 52 for subsequent analysis. In this way the extrinsic electronic device 52 enhances the trainee's ability to analyze and critique their performance for improving their skill in striking.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A strike recording punching bag assembly for recording pressure of a strike delivered during striking training, said assembly comprising:

a striking pad being positionable at a beneficial location for striking training wherein said striking pad is configured to receive strikes from a trainee;

a coupling being coupled to said striking pad wherein said coupling is configured to engage a support for retaining said striking pad on the support;

a pair of straps, each of said straps being coupled to said striking pad, each of said straps being matable to each other wherein each of said straps is configured to be secured around the support;

a striking panel being positioned within said striking pad, said striking panel having a plurality of depressions therein;

a plurality of pressure sensors, each of said pressure sensors being integrated into said striking pad wherein each of said pressure sensors is configured to sense pressure from strikes delivered to said striking pad, each of said pressure sensors being positioned in a respective one of said depressions; and a transmitter being integrated into said striking pad, said transmitter being in communication with each of said pressure sensors, said transmitter being in wireless communication with an extrinsic electronic device wherein said transmitter is configured to facilitate the extrinsic electronic device to display the pressure sensed by said pressure sensors for enhancing feedback to the trainee.

2. The assembly according to claim 1, wherein said striking pad has a forward wall and a rear wall, said striking pad being comprised of a resiliently compressible material wherein said striking pad is configured to enhance comfort for the trainee, said forward wall having indicia being printed thereon, said indicia comprising a plurality of intersecting lines defining a grid of rectangles positioned on said forward wall.

3. The assembly according to claim 2, wherein said coupling has a perimeter edge, said perimeter edge having first side and a second side, said first side being convexly arcuate with respect to said second side, said first side being bonded to said rear wall of said striking pad, said second side being free from said rear wall to define an opening into said coupling wherein said opening is configured to receive the support.

4. The assembly according to claim 3, wherein each of said straps is positioned on said rear wall of said striking pad, each of said straps having a distal end with respect to each other, said pair of straps being oriented such that said distal end of each of said straps is directed toward each other, said pair of straps forming a closed loop when said pair of straps is mated to each other, each of said straps being spaced from said second side of said perimeter edge of said coupling.

5. The assembly according to claim 2, wherein said striking panel has a front surface, each of said depressions being defined by a perimeter bounding wall extending rearwardly from said front surface and a rear bounding wall being spaced from said front surface, said front surface of said striking panel being bonded to an inside surface of said forward wall of said striking pad having said rear bounding wall of each of said depressions being spaced from said inside surface of said forward wall, each of said depressions being aligned with a respective one of said grid of rectangles on said forward wall.

6. The assembly according to claim 2, wherein each of said pressure sensors is positioned within the respective one of said depressions in said striking panel such that each of said pressure sensors is positioned behind an inside surface of said forward wall of said striking pad.

7. The assembly according to claim 1, further comprising a control circuit being integrated into said striking pad, said control circuit having each of said pressure sensors being electrically coupled thereto, said control circuit receiving pressure data from each of said pressure sensors when said pressure sensors are struck, said transmitter being electrically coupled to said control circuit.

8. A strike recording punching bag assembly for recording pressure of a strike delivered during striking training, said assembly comprising:

a striking pad being positionable at a beneficial location for striking training wherein said striking pad is configured to receive strikes from a trainee, said striking pad having a forward wall and a rear wall, said striking pad being comprised of a resiliently compressible material wherein said striking pad is configured to enhance comfort for the trainee, said forward wall having indicia being printed thereon, said indicia comprising a plurality of intersecting lines defining a grid of rectangles positioned on said forward wall;

a coupling being coupled to said striking pad wherein said coupling is configured to engage a support for retaining said striking pad on the support, said coupling having a perimeter edge, said perimeter edge having first side and a second side, said first side being convexly arcuate with respect to said second side, said first side being bonded to said rear wall of said striking pad, said second side being free from said rear wall to define an opening into said coupling wherein said opening is configured to receive the support;

a pair of straps, each of said straps being coupled to said striking pad, each of said straps being creatable to each other wherein each of said straps is configured to be secured around the support, each of said straps being positioned on said rear wall of said striking pad, each of said straps having a distal end with respect to each other, said pair of straps being oriented such that said distal end of each of said straps is directed toward each other, said pair of straps forming a closed loop when said pair of straps is mated to each other, each of said straps being spaced from said second side of said perimeter edge of said coupling;

a striking panel being positioned within said striking pad, said striking panel having a plurality of depressions therein, said striking panel having a front surface, each of said depressions being defined by a perimeter bounding wall extending rearwardly from said front surface and a rear bounding wall being spaced from said front surface, said front surface of said striking panel being bonded to an inside surface of said forward wall of said striking pad having said rear bounding wall of each of said depressions being spaced from said inside surface of said forward wall, each of said depressions being aligned with a respective one of said grid of rectangles on said forward wall;

a plurality of pressure sensors, each of said pressure sensors being integrated into said striking pad wherein each of said pressure sensors is configured to sense pressure from strikes delivered to said striking pad, each of said pressure sensors being positioned within a respective one of said depressions in said striking panel such that each of said pressure sensors is positioned behind said inside surface of said forward wall of said striking pad;

a control circuit being integrated into said striking pad, said control circuit having each of said pressure sensors being electrically coupled thereto, said control circuit receiving pressure data from each of said pressure sensors when said pressure sensors are struck;

a transmitter being integrated into said striking pad, said transmitter being electrically coupled to said control circuit, said transmitter receiving said pressure data from said control circuit, said transmitter being in wireless communication with an extrinsic electronic device wherein said transmitter is configured to facilitate the extrinsic electronic device to display the pressure sensed by said pressure sensors for enhancing feedback to the trainee; and a power supply being integrated into said striking pad, said power supply being electrically coupled to said control circuit, said power supply comprising at least one battery.

* * * * *